United States Patent [19]

Gablin

[11] 3,935,467

[45] Jan. 27, 1976

[54] REPOSITORY FOR FISSILE MATERIALS

[75] Inventor: Kenneth A. Gablin, Tacoma, Wash.

[73] Assignee: Nuclear Engineering Co., Inc., Louisville, Ky.

[22] Filed: July 1, 1974

[21] Appl. No.: 484,422

Related U.S. Application Data

[63] Continuation of Ser. No. 414,345, Nov. 9, 1973, abandoned, which is a continuation of Ser. No. 157,105, June 28, 1971, abandoned.

[52] U.S. Cl. ..... 250/507; 250/515; 252/301.1 W

[51] Int. Cl. ..... G21f 3/00

[58] Field of Search ..... 220/9 F; 252/301.1 W; 250/432, 507, 515

[56] References Cited

UNITED STATES PATENTS

| | | | |
|---|---|---|---|
| 3,213,031 | 10/1965 | Heinemann et al. | 252/301.1 W |
| R24,767 | 1/1960 | Simon et al. | 220/9 X |

*Primary Examiner*—James W. Lawrence
*Assistant Examiner*—Davis L. Willis
*Attorney, Agent, or Firm*—Murray K. Hatch

[57] ABSTRACT

A repository for holding and storing fissile or other hazardous materials either under or above the ground is provided by enclosing one or more inner containers, such as standard steel drums, in a larger, corrosion-resistant outer shell, with a layer of foamed polyurethane occupying the space therebetween. The polyurethane foam is free of voids at its interfaces with the inner container and outer shell, and adheres to and reinforces same to provide a stress skin structure. Protection is afforded by the chemical and physical characteristics of the polyurethane foam against destructive influences such as water vapor intrusion, package leakage and damaging effects of the environment, such as freezing, electrolysis, chemical and bacterial action. The outer shell is shaped to conform generally to the shape of the inner container and is made of a tube of bituminized fibre material with endcaps of exterior grade plywood treated with wood preservative. A quantity of fluorescein dye is positioned within the inner container for monitoring each package for leakage.

5 Claims, 3 Drawing Figures

INVENTOR.
KENNETH A. GABLIN
BY
Schapp & Hatch
ATTORNEYS

REPOSITORY FOR FISSILE MATERIALS

This is a continuation of application Ser. No. 414,345 filed Nov. 9, 1973, and now abandoned, which was a continuation of application Ser. No. 157,105 filed June 28, 1971 and now abandoned.

BACKGROUND OF THE INVENTION:

This invention relates to a REPOSITORY FOR FISSILE MATERIALS AND THE LIKE, and more particularly to containers adapted for storing such materials for long periods of time.

Inert garbage can be dumped, incinerated, or just plain neglected. Radioactive waste, however, is "alive" in the sense of being actively hazardous. The same care and precautions involved in the use of radioactive materials must also be exercised in the handling and final disposal of radioactive materials when they become waste. Even after it is buried, or otherwise stored, radioactive waste can remain "alive" for many years.

Regulations for the disposal and handling of radioactive wastes are specific and strict. In general they provide that all radioactive waste materials must be disposed of in such manner and in such a location as will result in no significant radioactive contamination of the environment.

A real need has arisen to store drums of fissile waste, such as plutonium, for up to 20 years. Such long term storage or holding of radioactive and other hazardous materials presents a number of problems in providing a suitable repository capable of maintaining its integrity and preventing leakage of the dangerous contents for 20 years or longer. To this end, the repository must be resistant to destructive forces in the surrounding environment. This problem is particularly acute where the repository is to be buried in the ground for many years and must be easily recoverable thereafter. Local, State and Federal governments place increasing emphasis on enactment and enforcement of anti-pollution laws. Dangerous insecticides, pesticides, acids, corrosives, and other hazardous materials must also be stored or held for long periods of time.

The repository of the present invention is particularly suited for confining and protecting fissile and other hazardous materials in a strong and leak-proof package capable of withstanding exterior deleterious influences, even under adverse environmental conditions such as burial under the ground. With all of these features, the repository of the present invention is relatively inexpensive and is capable of utilizing and protecting conventional transporting and storing devices, such as standard steel drums, in a strong and inexpensive package well suited to the described purposes.

The present repository is simple to assemble and use and is inherently self-sealing during assembly. Means is also provided for monitoring any leakage which might occur.

It is therefore an object of the present invention to provide a repository capable of containing radioactive and other hazardous materials for long term storage in a safe and efficient manner.

Another object of the invention is to provide a repository of the character described which is highly resistant to chemical, electrical and other destructive effects of the surrounding environment.

A further object of the invention is to provide a repository of the character described which is capable of safe and leak-proof storage of radioactive and other hazardous materials underground, and which may be quickly and easily retrieved at any time.

A still further object of the invention is to provide a repository of the character set forth which is capable of utilizing conventional transporting and storage containers as an integral part of the repository package.

Yet another object of the present invention is to provide a sturdy and simple repository of the character set forth which is economical and simple to manufacture and use.

Other objects and features of advantage will become apparent from the following specification and from the claims.

IN THE DRAWINGS

Figure 1:
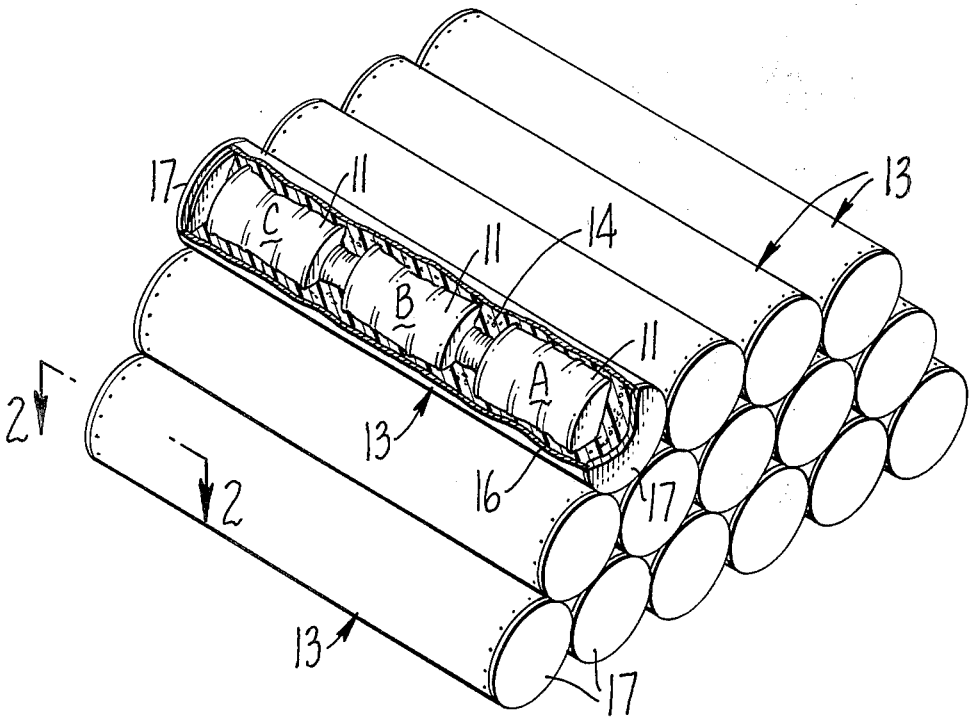
FIG. 1 is a perspective view of a stack of repositories for fissile and other hazardous materials constructed in accordance with the present invention, with portions of one of the repositories being broken away and shown in section to reveal details of internal construction.
Figure 2:
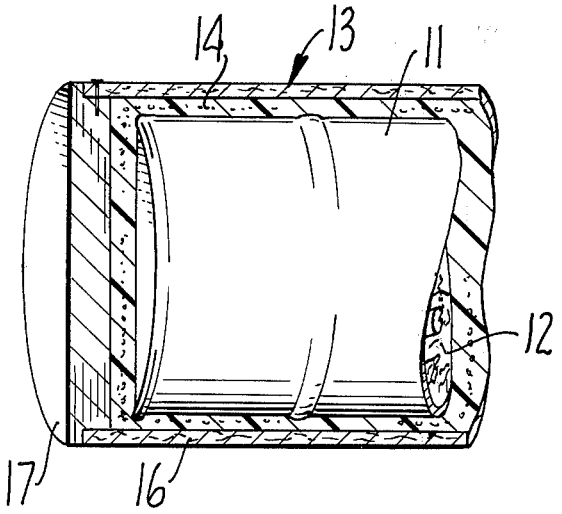
FIG. 2 is a longitudinal sectional view on an enlarged scale of an end portion of one of the repositories and is taken substantially on the plane of line 2-2 of FIG. 1.

While only the preferred forms of the invention have been shown in the drawings, it will be apparent that changes and modifications could be made thereto within the ambit of the invention as defined in the claims hereto.

DESCRIPTION OF THE PREFERRED EMBODIMENTS

Referring to the drawing in detail, it will be seen that the repository for fissile and other hazardous materials, of the present invention, consists basically of an inner container 11 adapted for enclosing a quantity of material 12 to be stored, an outer shell 13 enclosing the inner container 11 in spaced relation thereto, and a layer 14 of foam material occupying the space between the inner container 11 and the outer shell 13. For versatility and economy, the inner container 11 may be of standard size and shape, such as a conventional 55 gallon steel drum, and the outer shell 13 is of generally similar shape to provide a fairly uniform layer 14 of foam material.

The outer shell 13 is resistant to corrosion and other deleterious effects encountered in underground or above ground storage so the package will retain its shape and integrity for many years, even under adverse conditions. As here shown, outer shell 13 includes an elongated tube 16 of bituminous fibre material and endcaps 17 made of exterior grade plywood treated with wood preservative for underground preservation. A suitable material for the tube 16 is a bituminized fibre manufactured by Sonoco Products Company. The plywood endcaps may be fabricated from any good exterior grade plywood having water-insoluble glue and treated with any good long range wood preservative material such as creosote or other readily available commercial products.

As an important feature of the present invention, the layer 14 of foam material provides protection against leakage of the material 12 from the repository and protects the inner container 11 against destructive effects of adverse environmental conditions.

To accomplish these results, the foam material must be substantially impervious to penetration by ground water or water vapor, and highly resistant to corrosion or breaking down under the influence of chemicals which might seep in through the outer shell 13, or to chemicals which might seep out of an inner container 11. In addition, the material chosen should have high dielectric strength to protect the inner container from destruction caused by electrolysis, cathodic action, or other electrical phenomena, and must be highly resistant to bacterial enzymes and the like which can be equally destructive.

In accordance with the invention, the foam material used offers some thermal protection against the freeze-thaw cycles and mechanically reinforces the inner container 11 and outer shell 13 to provide maximum strength with the materials used. To accomplish the latter result, the foam material provides a good stressed skin structure in cooperation with the walls of the inner container 11 and outer shell 13. The foam material adheres and bonds to the inner container 11 and outer shell 13 at its interfaces therewith, and the foam material is stiff enough and strong enough to produce the described stressed skin construction and give the composite structure the stiffness and strength required to load and unload this package from transporting vehicles using normal slinging hardware and a crane.

Preferably, the layer 14 of foam material is formed of polyurethane having the described physical characteristics. While the foam material could conceivably be precast in a number of mating sections, joined together and adhered to the inner container 11 and outer shell 13 by suitable adhesives, it has been found that foaming and subsequent polymerization of liquid polyurethane, in situ, materially reduces the time and complexity of assembly and provides a sounder structure.

The polyurethane foam is a cellular plastic that is formed by the reaction of two liquids. A polyol and a polyisocyanate are contacted in the presence of a gas producing agent such as Trichloromonofluormethane, also known as refrigerant-11. As the chemical reaction takes place, heat is generated causing the gas producing agent to vaporize and form tiny bubbles. The creation of these bubbles generates foam which expands to its full height in less than five minutes. The net result of the chemical reaction is one giant cross linked molecule of cellular plastic containing entrapped bubbles of gas.

The cellular structure of rigid urethane gives it exceptional strength for its light weight. Compressive strength can be varied from 25 psi to over 500 psi through alteration of formulation. The closed cells, in addition to contributing to strength, also seals the foam against penetration of gases or liquid. Gas contained in the cells not only shapes the cells but also contributes to the thermal insulating capabilities of the foam material.

It has been found that when the above-mentioned liquid materials are mixed and allowed to foam and expand in the space between the inner container 11 and outer shell 13, the polyurethane material bonds tightly to the surfaces it encounters. Since the wall of the inner container and the wall of the outer container are attached by means of the rigid polyurethane foam, the resulting structure provides a stress skin effect and a stronger and more rigid structure per unit weight.

In the preferred form of the invention, as illustrated in FIG. 1 of the drawing, a plurality of inner containers

11, in the form of conventional metal drums A, B and C are positioned in axially aligned and spaced relation in the tube 13. One of the endcaps 17 is attached to the tube 16, and the tube is errected to stand upright on that end. Relatively small blocks of rigid polyurethane foam (not shown) may be positioned between the endcap and the lower drum, and also between the drums, to support them in the desired position, or the drums may be supported in any other suitable manner. The liquid polyurethane material is then poured into tube 16, the upper endcap is held in place, the liquid mixture is allowed to foam up and occupy all of the space within the tube not occupied by the drums and supporting foam blocks, and the foamed material is allowed to set. The foaming is produced by vaporization of the refrigerant 11 due to temperature rise caused by the exothermic reaction between the other liquids, and foaming is preferably substantially nonexistant at the interfaces between the polyurethane material and the inner container and outer shell.

If the surfaces contacted by the polyurethane material are clean and below the boiling temperature of the refrigerant-11, the liquid material at these surfaces will react in much the same way the two components would have reacted without the addition of the refrigerant-11. This substantially eliminates voids or cells in this area, making a hard surface which is very strong and is adhesive both to the foam and the materials of the inner container and outer shell. Further out into the polyurethane material, the "heat sink" effect is less noticeable and the exothermic heat of the reaction raises the temperature above the vaporization point of refrigerant-11. This, of course, causes foaming in the locations remote from the interfaces so that the structure varies in average density.

Figure 3:
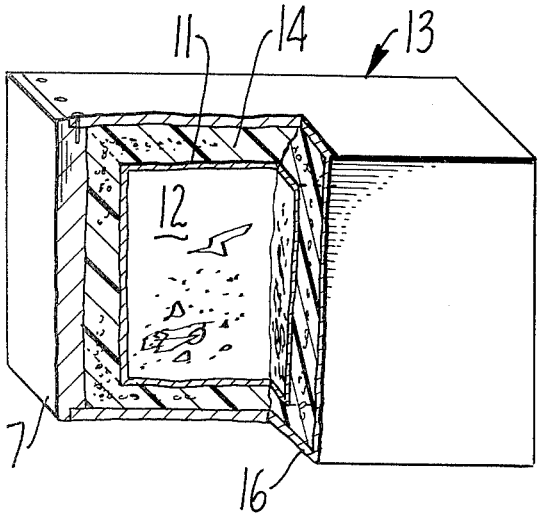
FIG. 3 is a longitudinal sectional view similar to that of FIG. 2, but illustrating a modified form of the invention utilizing a single inner container.

As is apparent from FIG. 3 of the drawings, the repository of the present invention can be made in configurations other than that described in connection with FIG. 1. In any of these variations, the outer shell 13 should preferably be similar in shape to the configuration of the inner container or containers 11, but larger, in order to provide a fairly uniform layer of the rigid polyurethane foam material. Whatever the configuration, it is desired to position a water soluble package of a water soluble dye, such as fluorescein dye, within each of the inner containers 11 for visually indicating any accidental leakage. In practice, one or more of the repositories of the present invention are usually buried underground and covered with earth. Water runoff, drainage, etc. are usually monitored to make certain that no radioactive material is escaping. The fluorescein dye materially facilitates such monitoring.

From the foregoing, it will be seen that the repository for fissile and other hazardous material of the present invention provides for economical and safe storage and disposal of radioactive waste materials and other hazardous waste materials over long periods of many years duration, protecting the surrounding environment from contamination and being readily retrievable whenever desired.

I claim:

1. A repository for fissile material, comprising a plurality of metal drums adapted for sealed containment of fissile materials and the like, said drums being positioned in axially aligned and spaced relation, an elongated cylindrical rigid tube surrounding said drums in concentrically spaced relation thereto and formed of bituminized fibre material, end caps of exterior grade plywood treated with wood preservative secured in sealing relation to the opposite ends of said cylindrical tube, and a continuous body of foamed polyurethane material occupying the space between said drums and the spaces between said drums and said cylindrical tube and endcaps, said polyurethane material being adherent to said drums and tube and endcaps and of substantial stiffness to provide a reinforcing action, said polyurethane material being formed in situ to provide multiple small voids therein except adjacent to said drums and tubes and endcaps.

2. A repository for underground storage of radioactive waste material, comprising a sealed metal shell adapted to contain a quantity of radioactive material, a sealed rigid outer cover enclosing said metal shell in spaced relation thereto, and a layer of foam material occupying the space between said metal shell and said outer cover, said foam material being substantially free of voids at and adjacent to said metal shell and having increasing amounts of voids as the distance from said metal shell increases, said foam material being rigidly compressible and adhered to said shell and said cover to provide a stress skin wall structure, and said cover being formed of material resistant to corrosion and non-degradable when stored in the earth for a period of years.

3. A repository as described in claim 2 and wherein said foam material comprises an isocyanate mixed with a polyol and trichloromonofluormethane and foamed within said space between said metal shell and said outer cover.

4. A repository as described in claim 2 and wherein said metal shell is of rectangular box configuration, and said outer cover is of larger but corresponding configuration to provide said space therebetween.

5. A repository as described in claim 2 and wherein said metal shell is of cylindrical configuration, and wherein said outer cover is a similar cylinder of larger size to provide said space therebetween.

* * * * *